US005890050A

United States Patent [19]

Kaneda

[11] Patent Number: 5,890,050

[45] Date of Patent: Mar. 30, 1999

[54] SORTER HAVING A CONTROLLER WHICH ADJUSTS FOR DIFFERENT TYPES OF PAPER USED IN AN IMAGE FORMING APPARATUS

[75] Inventor: Hiroshi Kaneda, Ibaraki, Japan

[73] Assignee: Riso Kagaku Corporation, Tokyo, Japan

[21] Appl. No.: 855,542

[22] Filed: May 13, 1997

[30] Foreign Application Priority Data

May 13, 1996 [JP] Japan ..... 8-117727

[51] Int. Cl.[6] ..... G03G 15/00

[52] U.S. Cl. ..... 399/403; 270/58.18; 271/288; 271/298; 271/303; 399/405

[58] Field of Search ..... 399/45, 397, 403, 399/405, 407; 271/262, 303, 288–290, 296, 298; 270/58.04, 58.14, 58.18

[56] References Cited

U.S. PATENT DOCUMENTS

| | | | |
|---|---|---|---|
| 4,449,813 | 5/1984 | Kikuchi et al. | 399/403 X |
| 4,469,323 | 9/1984 | Miyashita et al. | 271/288 |
| 4,548,402 | 10/1985 | Namba | 271/290 |
| 4,835,573 | 5/1989 | Rohrer et al. | 399/45 X |
| 4,887,060 | 12/1989 | Kaneko | 399/403 |
| 5,073,801 | 12/1991 | Haneda et al. | 399/45 |
| 5,182,607 | 1/1993 | Braswell et al. | 399/403 |
| 5,202,738 | 4/1993 | Braswell et al. | 399/364 |
| 5,598,258 | 1/1997 | Sato et al. | 399/85 |

FOREIGN PATENT DOCUMENTS 2 059 396 4/1981 United Kingdom .

OTHER PUBLICATIONS

Patent Abstracts Of Japan, vol. 096, No. 011, Nov. 29, 1996 & JP 08 169628 A (Tohoku Ricoh Co Ltd; Canon Aptecs KK) *Abstract.

Patent Abstracts Of Japan vol. 095, No. 010, Nov. 30, 1995 & JP 07 187476 A (Canon Inc) Jul. 25, 1995, *Abstract.

*Primary Examiner*—William Royer

*Attorney, Agent, or Firm*—Sughrue, Mion, Zinn, Macpeak & Seas, PLLC

[57] ABSTRACT

A sorter for sorting a printed sheet discharged from an image forming machine includes a plurality of bins arranged in a vertical direction; a conveyer provided vertically along the plurality of bins to convey the printed sheet vertically downward; an indexer having a guide surface in its upper portion, being vertically movable along a sheet travel route of the conveyer, for peeling the printed sheet off the conveyer with the guide surface and sending the printed sheet in either one of the plurality of bins; a controller connecting for driving the conveyer and the indexer; and an operating panel-connecting to the controller. The operating panel receives a printing sheet information of the sheet to be printed and feeds the information to the controller, and the controller determines a vertical distance between a bottom surface of an upstream-side end portion of the bin and a downstream-side end portion of the guide surface of the printed sheet guide means in response to the information from the operating panel.

12 Claims, 12 Drawing Sheets

SORTER HAVING A CONTROLLER WHICH ADJUSTS FOR DIFFERENT TYPES OF PAPER USED IN AN IMAGE FORMING APPARATUS

BACKGROUND OF THE INVENTION

The present invention relates to a sheet post-processing unit such as a sorter for distributing and accommodating printed sheets discharged from an image forming machine, and to an image forming apparatus having the sheet post processing unit and an image forming machine such as a copying machine, a printer and the like for forming images on a printing sheet.

Various types of sheet post-processing units for distributing printed papers which have images formed thereon and discharged from a stencil printing machine have heretofore been developed and put to practical use. Sheet post-processing units of the sorts mentioned above are desired to be devised so that while every possible effort is made for size reduction, a larger number of printed sheets may be distributable.

In such a sheet post-processing unit of a fixed bin type, a plurality of bins are fixedly arranged in the vertical direction of a casing and conveyer units having fans and blowers are installed in the vertical direction of the plurality of bins and besides indexers as sheet guide means for carrying printed papers into the corresponding bins are moved up and down vertically along travel routes of the conveyer units. Therefore, an attempt has been made to reduce the size of the whole apparatus by decreasing the dimension thereof in the depth direction. With respect to the conveyer unit, moreover, the diameter of a corner portion at both ends of a belt has also been designed for its size to be minimized. However, the following problems still exist because various types of paper are used as printing sheet in the stencil printing machine and aforementioned paper post-processing unit.

In the sheet post-processing unit thus arranged as described above, an indexer 116 is moved up or down to the position of a target bin 78 and the printed sheet P conveyed from a conveyer unit 92 is peeled off the belt surface at the indexer 116, guided to and accommodated in the target bin 78 as shown in FIG. 12. When the printed sheet P is carried into each bin 78 from the indexer 116, however, not only a paper jam percentage but also accommodating capacity per bin may greatly vary if the stop position of the indexer 116 is unchanged even in a case where the paper thickness varies.

More specifically, no problem will particularly be caused even though the stop position of the indexer with respect to the bin 78 is left unchanged in a case where the printed sheet P conveyed from the conveyer unit 92 is ordinary paper. Nevertheless, the thick printed paper P conveyed from the conveyer unit 92 for next distribution becomes unaccommodated in the target bin 78 because it is blocked by sheets of printed paper P that have already been stacked up therein as the number of printed sheets per bin increases. Consequently, the paper accommodating capacity per bin tends to decrease.

In the sheet post-processing unit thus arranged as described above, further, a corner portion in the travel route of the conveyer unit 92 is considerably curved and therefore one end of printed sheet tends to become easily curled in the corner portion of the belt, depending on the type of sheet (see FIG. 12). Therefore, as in the case where thicker printed papers are distributed, a paper jam is readily produced in the proximity of the entrance of the bin 78 with respect to the indexer 116 since the printed paper conveyed from the conveyer unit 92 for next distribution becomes unaccommodated in the target bin 78 as it is blocked by the sheets of printed paper P that have already been stacked up therein.

When a large number of thick printed papers are accommodated in one bin or when the end of that type of paper becomes curled in the travel route, printed paper for next distribution becomes unaccommodated in the target bin as it is blocked by the sheets of printed paper P that have already been stacked up therein, which results in not only decreasing the paper accommodating capacity but also causing a paper jam.

SUMMARY OF THE INVENTION

In view of the foregoing problems, an object of the present invention is to provide an image forming system capable of stably conveying printed sheet such as a printing paper and the like, reducing a sheet jam percentage and improving paper accommodating capacity per bin.

In order to accomplish the above and other objects, an image forming apparatus of the present invention comprises: a plurality of bins arranged in a vertical direction; conveyer means which is provided vertically along the plurality of bins and used for vertically conveying printed sheet downward discharged from an image forming means; printed sheet guide means which has a guide surface in its upper portion, is capable of moving up and down along the sheet travel route of the conveyer means, for introducing the printed sheet conveyed by the conveyer means onto the guide surface and into one of the plurality of bins; control means for driving the conveyer means and the printed sheet guide means in accordance with the printed sheet discharged from the image forming means; and printing sheet information input means for inputting to the control means information on the thickness of printing sheet for use in the image forming means, wherein the control means variably controls the vertical distance between the bottom surface of the upstream-side end portion of the bin and the downstream-side end portion of the guide surface of the printed sheet guide means in response to the output of the printing sheet information input means when a printed sheet is inserted in one of the plurality of bins by moving up or down the printed sheet guide means.

In an image forming apparatus above, the printing sheet information input means may be arranged so that it inputs to the control means a signal which is turned on·off in accordance with the variation of pressure applied to the printing sheet supplied to the image forming means as information on the thickness of the printing sheet.

In an image forming apparatus above, the printing sheet information input means may be arranged so that it inputs to the control means a key signal which is operated in accordance with the thickness of the printing sheet as information on the thickness of the printing sheet.

According to another aspect of the invention, there is provided an image forming apparatus comprising: a plurality of bins arranged in a vertical direction; conveyer means which is provided vertically along the plurality of bins and used for vertically conveying printed sheet downward discharged from an image forming means; printed sheet guide means which has a guide surface in its upper portion, is capable of moving up and down along the sheet travel route of the conveyer means and used for introducing the printed sheet conveyed by the conveyer means onto the guide surface and into one of the plurality of bins; control means for driving the conveyer means and the printed paper guide means in accordance with the printed sheet discharged from the image forming means; and printing paper information input means for inputting to the control means information on the density of printing sheet for use in the image forming means, wherein the control means variably controls the vertical distance between the bottom surface of the upstream-side end portion of the bin and the downstream-side end portion of the guide surface of the printed sheet guide means in response to the output of the printing sheet information input means when a printed sheet is inserted in one of the plurality of bins by moving up or down the printed sheet guide means.

In an image forming apparatus above, moreover, the printing sheet information input means may be arranged so that it inputs to the control means a key signal which is operated in accordance with the density of the printing sheet as information on the density of the printing sheet.

According to a further aspect of the invention, there is provided an image forming apparatus comprising: a plurality of bins arranged in a vertical direction; conveyer means which is provided vertically along the plurality of bins and used for vertically conveying printed sheet downward discharged from an image forming means; printed paper guide means which has a guide surface in its upper portion, is capable of moving up and down along the sheet travel route of the conveyer means and used for introducing the printed sheet conveyed by the conveyer means onto the guide surface and into one of the plurality of bins; control means for driving the conveyer means and the printed sheet guide means in accordance with the printed sheet discharged from the image forming means; printing sheet information input means for inputting to the control means information on the thickness of printing sheet for use in the image forming means; and number-of-sheets information input means for inputting to the control means information on the number of printed sheets which are inserted in each of the plurality of bins, wherein the control means variably controls the vertical distance between the bottom surface of the upstream-side end portion of the bin and the downstream-side end portion of the guide surface of the printed sheet guide means in response to the output of the printing sheet information input means and the output of the number-of-sheets information input means when the printed sheet is inserted in one of the plurality of bins by moving up or down the printed sheet guide means.

According to a further aspect of the invention, there is provided an image forming apparatus comprising: a plurality of bins arranged in a vertical direction; conveyer means which is provided vertically along the plurality of bins and used for vertically conveying printed sheet downward discharged from an image forming means; printed sheet guide means which has a guide surface in its upper portion, is capable of moving up and down along the sheet travel route of the conveyer means, for introducing the printed sheet conveyed by the conveyer means onto the guide surface and into one of the plurality of bins; control means for driving the conveyer means and the printed sheet guide means in accordance with the printed sheet discharged from the image forming means; printing sheet information input means for inputting to the control means information on the density of printing sheet for use in the image forming means; and number-of-sheets information input means for inputting to the control means information on the number of the printed sheets which are inserted in each of the plurality of bins, wherein the control means variably controls the vertical distance between the bottom surface of the upstream-side end portion of the bin and the downstream-side end portion of the guide surface of the printed sheet guide means in response to the output of the printing sheet information input means and the output of the number-of-sheets information input means when printed sheet is inserted in one of the plurality of bins by moving up or down the printed sheet guide means.

According to the present invention, the relative position of the indexer to the bin is variably controlled according to the information on the thickness of printing paper and the like, whereby a paper jam percentage is reducible and paper accommodating capacity per bin is improvable when printed papers are distributed to each bin.

DETAILED DESCRIPTION OF THE PREFERRED EMBODIMENTS

Figure 1:
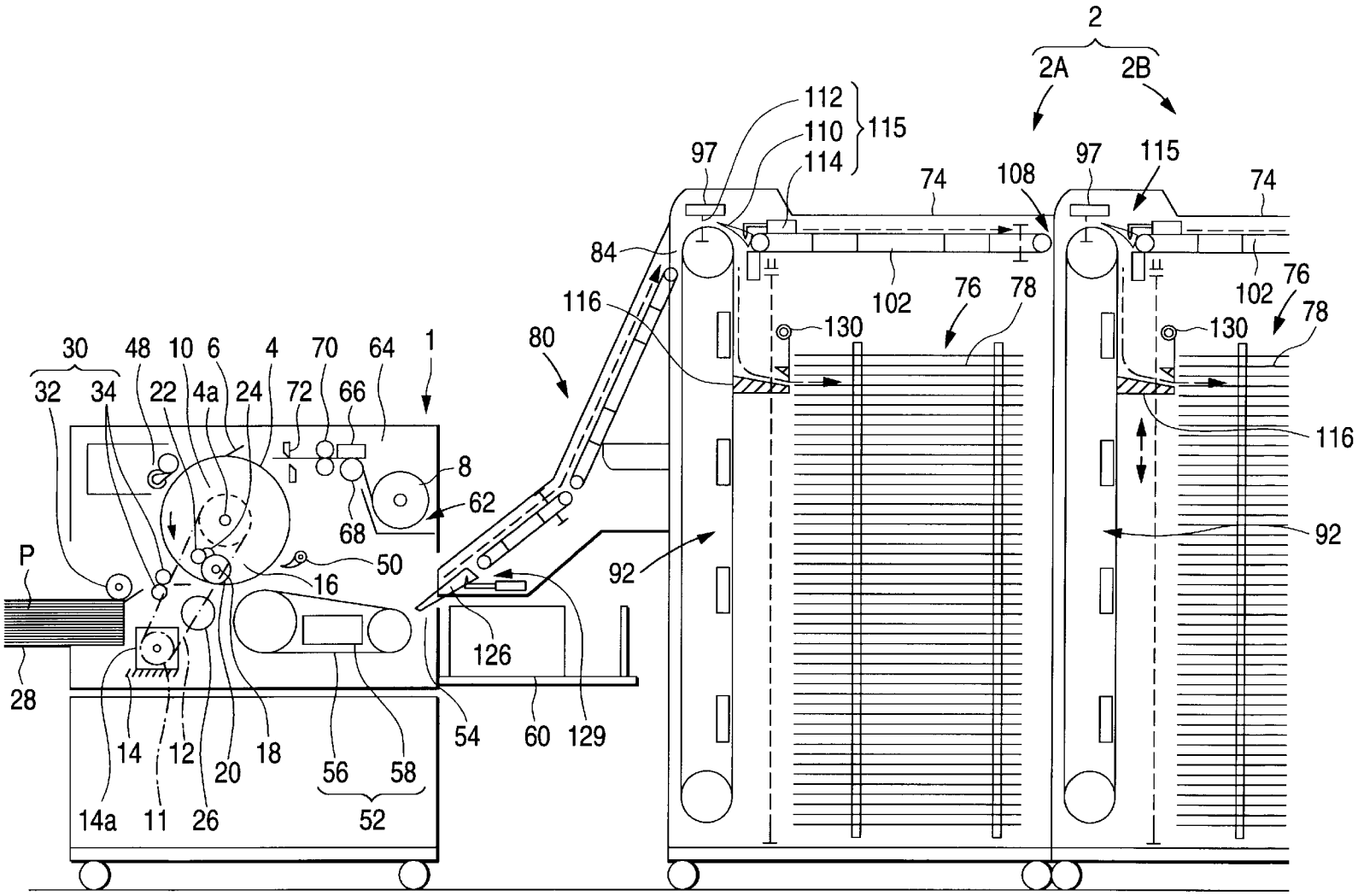
FIG. 1 shows an overall block diagram of an image forming apparatus according to the present invention.

FIG. 1 is an overall block diagram of an image forming apparatus according to the present invention. The image forming apparatus comprises a stencil printing machine 1 as an image forming machine and a sorter 2 as a sheet post-processing unit.

A description will be given of the construction of the stencil printing machine 1 first. The stencil printing machine 1 has a cylindrical drum 4 rotatably supported with a machine frame (not shown) round the center axis of the cylindrical drum 4. The cylindrical drum 4 is porous in structure and fitted with a clamp mechanism 6 on its outer peripheral portion. The clamp mechanism 6 retains one end of a stencil 8.

The cylindrical drum 4 is coupled to and driven by a sprocket 10 installed in a manner coaxial with the center axis 4*a*. An endless belt 12 is used for coupling the sprocket 10 to the driving sprocket 11 of the drum driving motor 14*a* of a drum driving mechanism 14. The motive power of the drum driving motor 14*a* of the drum driving mechanism 14 works to drive the cylindrical drum 4 to rotate counterclockwise intermittently or continuously.

A printing ink supply means 16 is provided in the body of the cylindrical drum 4. The printing ink supply means 16 is disposed so that its outer peripheral face is brought into contact with the inner peripheral face of the cylindrical drum 4. The printing ink supply means 16 has a squeegee roller 20 capable of rotation round the center axis 18 of the printing ink supply means 16, and a doctor roller 22 extending along the direction of the generating line of the squeegee roller 20 with a predetermined space left with respect to the outer peripheral face of the squeegee roller 20. The printing ink supply means 16 is used for supplying printing ink in an ink reservoir 24 onto the inner peripheral face of the cylindrical drum 4 when the squeegee roller 20 is driven to rotate synchronously in the same direction in which the cylindrical drum 4 rotates.

The printing ink in the ink reservoir 24 is passed through the space between the squeegee roller 20 and the doctor roller 22 as the squeegee roller 20 rotates, where the ink is metered so that a printing ink layer uniform in thickness may be formed on the outer peripheral face of the squeegee roller 20. The printing ink layer is applied to the inner peripheral face of the cylindrical drum 4 for printing purposes as the squeegee roller 20 rotates. A press roller 26 for pressing printing sheet P against the cylindrical drum 4 installed opposite to the squeegee roller 20 is positioned outside the cylindrical drum 4.

A sheet feed tray 28 for setting a printing sheet P, such as a printing paper, to be fed between the cylindrical drum 4 and the press roller 26 is installed in a left-hand diagonally-downward position. The sheet feed tray 28 is moved up and down by a driving unit (not shown) in proportion to the quantity of laminated printing sheets P thus set thereon.

A sheet feed mechanism 30 is positioned in the proximity of the sheet feed tray 28. The sheet feed mechanism 30 has a sheet feed roller 32 made of, for example, rubber and a pair of timing rollers 34. The sheet feed roller 32 picks up the uppermost sheet of printing papers P out of those stacked on the sheet feed tray 28 one by one and conveys that printing sheet P toward the timing roller side 34. While temporarily holding the printing sheet P conveyed from the sheet feed roller 32 in such a state as to form a predetermined roller-to-roller loop, the timing rollers 34 rotate at predetermined timing in synchronization with the rotation of the cylindrical drum 4 in order to convey the printing sheet P toward the cylindrical drum 4 when the printing operation is performed.

A stencil discharge mechanism 48 is provided round the cylindrical drum 4 and above the sheet feed tray 28. The stencil discharge mechanism 48 is used for peeling off the used stencil wound on the outer peripheral face of the cylindrical drum 4 as the cylindrical drum 4 rotates and for accommodating the stencils discharged. A printed sheet separating pawl 50 is provided round the cylindrical drum 4 and in a position opposite to the sheet feed mechanism 30.

The printed sheet separating pawl 50 is used for removing the printed sheet P subjected to printing from the cylindrical drum 4. The printed sheet P peeled off by the printed sheet separating pawl 50 is conveyed by a sheet discharge unit 52 toward a sheet discharge port 54. The sheet discharge unit 52 has a belt conveyer unit 56 and a suction unit 58; while the printed sheet P peeled by the printed sheet separating pawl 50 off the cylindrical drum 4 is being air-drawn by the suction unit 58, it is conveyed by the belt conveyer unit 56 toward the sheet discharge port 54.

A sheet discharge tray 60 as a stacker unit is installed in the rear of the sheet discharge port 54. In a selected non-sort mode, which will be described later, the sheet discharge tray 60 accommodates the printed sheet P conveyed from the sheet discharge unit 52. A stencil storage unit 62, which is installed above the paper discharge unit 52, stores the continuous sheet-like stencil 8 wound in the form of a roll.

A making mechanism 64 is installed between the stencil storage unit 62 and the cylindrical drum 4. The making mechanism 64 has a thermal head 66 and a platen roller 68 which is positioned opposite thereto. The making mechanism 64 thermally makes up the printing stencil supplied from the stencil storage unit 62.

The thermal head 66, though not shown in FIG. 1, has a plurality of heating elements arranged in a line, that is, at fixed intervals in the main scanning direction. The heating elements of the thermal head 66 are arranged so that they selectively generate heat in response to the image information signal read by a read unit (not shown). The printing stencil made up by the making mechanism 64 is conveyed by a stencil conveyer roller 70 toward the cylindrical drum 4. There is also installed a cutter unit 72 between the making mechanism 64 and the cylindrical drum 4, the cutter unit 72 being used to cut the stencil 8 at a point of time the made-up stencil has been wound on the outer peripheral face of the cylindrical drum 4 to a desired extent.

A description will subsequently be given of the sorter 2. The sorter 2 has a bin train 76 for accommodating the printed sheets P conveyed from the stencil printing machine 1. The sorter 2 is arranged so that its multi-stage connection to the stencil printing machine 1 is made possible. In the example shown in FIG. 1, two sorters 2, namely, a preceding-stage first sorter 2A and a following-stage second sorter 2B, are coupled to the stencil printing machine 1.

The first and second sorters 2A, 2B are similar in construction except that only the first sorter 2A has an approach conveyer mechanism 80, which will be described later. A detailed description will thereupon be given of the construction of only the first sorter 2A by reference of FIG. 2.

The bin train 76 has a plurality of bins 78 which are each formed with similar rectangular plate members. These bins 78 are arranged in layers at predetermined intervals d in the height direction (vertical direction) of a casing 74 and fixed to the rear portion of the casing 74 inside.

The approach conveyer mechanism 80 for introducing and conveying the printed sheet P from the stencil printing machine 1 into the casing 74 is provided on one side of the casing 74, which side is facing the sheet discharge port 54 of the stencil printing machine 1. The approach conveyer mechanism 80 has two belt conveyer units: a preceding-stage belt conveyer unit 82 and a following-stage belt conveyer unit 86.

The belt conveyer units 82, 86 are driven by, for example, DC motors as driving means, respectively. Further, a plurality of suction units 88 in the form of blowers are provided for the respective belt conveyer units 82, 86 at predetermined intervals in the direction in which the printed sheet P is conveyed.

While air-drawing the printed sheet P discharged from the sheet discharge port 54 of the stencil printing machine 1 by means of the suction units 88, the preceding-stage belt conveyer unit 82 takes in and conveys the printed sheet P to the following-stage belt conveyer unit 86. While air-drawing the printed sheet P taken in from the preceding-stage belt conveyer unit 82 by means of the suction units 88, the following-stage belt conveyer unit 86 conveys the printed sheet P diagonally upward up to a sheet introducing port 84 in the upper end portion of one side of the casing 74.

A bin guide conveyer mechanism 92 is provided along the height direction (vertical direction) of the casing 74 under the sheet introducing port 84 in the casing 74. Similar to the approach conveyer mechanism 80, the bin guide conveyer mechanism 92 has a belt conveyer unit 94 and suction units 96 and driven by a driving means such as a DC motor or the like. While air-drawing the printed sheet P conveyed from the following-stage belt conveyer unit 86 up to the sheet introducing port 84 by means of the suction units 96, the bin guide conveyer mechanism 92 causes the belt conveyer unit 94 to have the printed sheet P make a U-turn in its curved corner portion and then conveys the printed sheet P downward in the vertical direction of the bin train 76.

Figure 3:
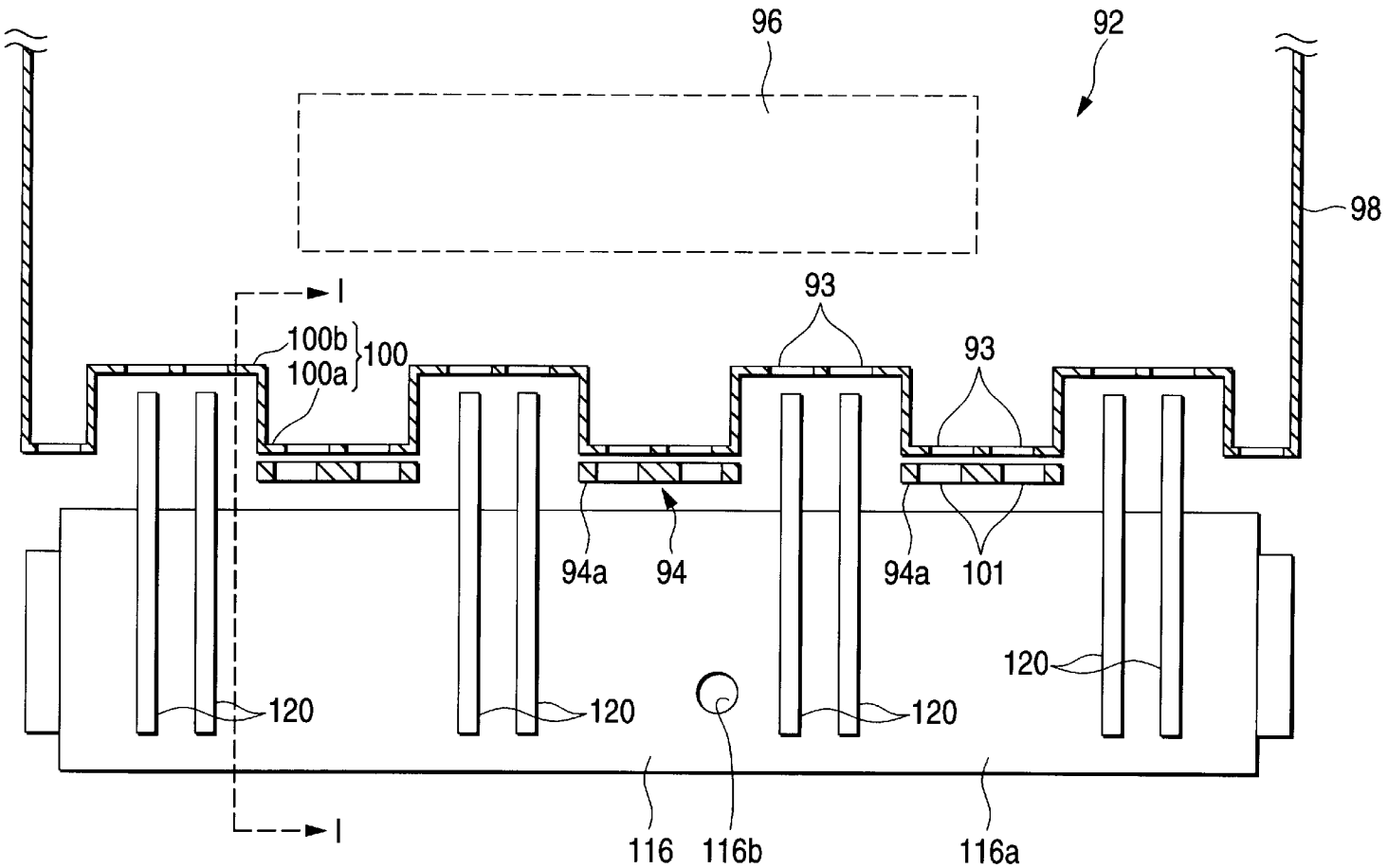
FIG. 3 is a partial enlarged view of a bin guide conveyer unit and an indexer in the image forming apparatus of the invention.
Figure 4:
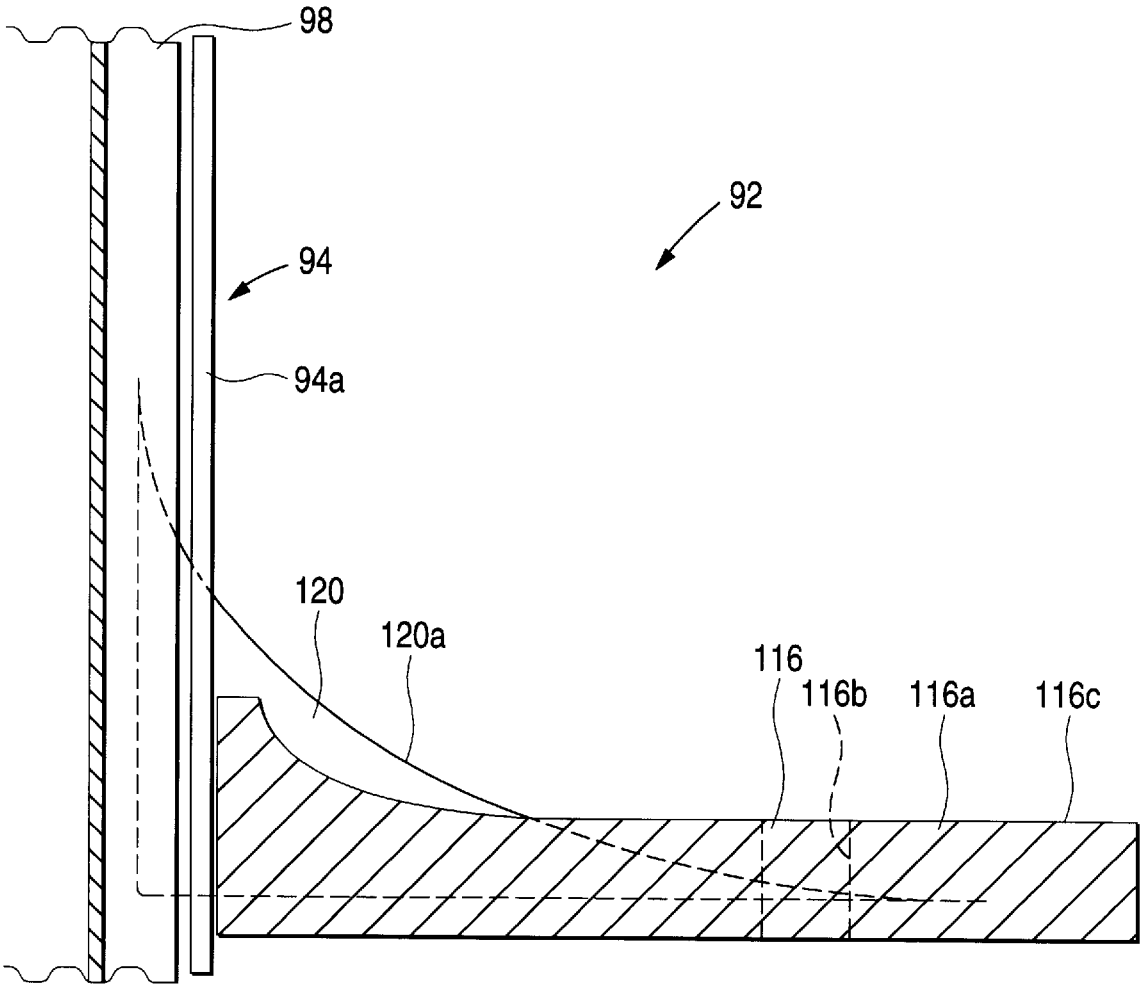
FIG. 4 is a sectional view taken on line I—I of FIG. 3.

FIG. 3 is a partial enlarged sectional view of the bin guide conveyer unit 92 and the indexer 116, which will be described later, as viewed from the upward; and FIG. 4 is a sectional view taken on line I—I of FIG. 3. A comb-like stepped portion 100 is formed in the surface of a frame 98 forming the base of the bin guide conveyer unit 92, the printed sheet P being conveyed on the surface thereof. In the stepped portion 100, through-holes 93 for drawing the printed sheet P are formed at predetermined intervals. An endless conveyer belt 94*a* in the belt conveyer unit 94 is provided for each protrusion 100*a* of the stepped portion 100 (actually three places in this embodiment shown).

Through-holes 101 are formed in the endless conveyer belt 94*a* in positions opposite to the respective through-holes 93 of the protrusion 100*a*. The air-suction force of the suction unit 96 works to air-draw the printed sheet P via the through-holes 93, 101 to the surface of the conveyer belt 94*a* and the printed sheet P is conveyed in such a state that it is kept sticking to the surface of the conveyer belt 94*a*.

A fan 97 as a blower for pressing the printed sheet P conveyed from the approach conveyer mechanism 80 against the surface of the belt and for sticking the printed sheet P thereon is installed in the proximity of the outer periphery of the top portion of the belt conveyer unit 94.

A sorter passage conveyer mechanism 102 for conveying the printed sheet P to the second sorter 2B connected to the preceding stage is installed above the bin train 76. Similar to the approach conveyer mechanism 80 and the bin guide conveyer mechanism 92, the sorter passage conveyer mechanism 102 has a belt conveyer unit 104 and a suction unit 106 and driven by, for example, a DC motor-as a driving means.

While air-drawing the printed sheet P conveyed by the following-stage belt conveyer unit 86 up to the sheet introducing port 84 by means of the suction unit 106, the sorter passage conveyer mechanism 102 discharges the printed sheet P from a sheet discharge -port 108 in the upper end portion of the other side face of the casing 74 by means of the belt conveyer unit 104 and conveys the printed sheet P up to the sheet introducing port 84 of the second sorter 2B. Incidentally, the sorter passage conveyer mechanism 102 is unnecessary when only one sorter 2 is connected to the stencil printing machine 1.

A sheet passage sensor 109 is installed on the exit side of the belt conveyer unit 104 in the sorter passage conveyer mechanism 102. The paper passage sensor 109 detects the presence or absence of the passage of the printed sheet P conveyed on the belt conveyer unit 104 before being introduced into the sheet introducing port 84 of the second sorter 2B from the sheet discharge port 108.

A sorter switching plate 110 is installed in the proximity of the sheet introducing port 84 on the entrance side of the sorter passage conveyer mechanism 102. A sorter switching sensor 112 is installed in the proximity of the sheet introducing port 84 on the entrance side of the sorter switching plate 110. The sorter switching sensor 112 is used for detecting the printed sheet P introduced into the sheet introducing port 84 from the approach conveyer mechanism 80 and conveyed therethrough.

The sorter switching plate 110 is switched under the control of a solenoid 114 which is turned on and off in conformity with not only the number of printed sheets P conveyed to the preceding-stage first sorter 2A connected to the stencil printing machine 1 but also the set mode. In this case, the sorter switching plate 110, the sorter switching sensor 112 and the solenoid 114 constitute a sorter switching mechanism 115.

Figure 2:
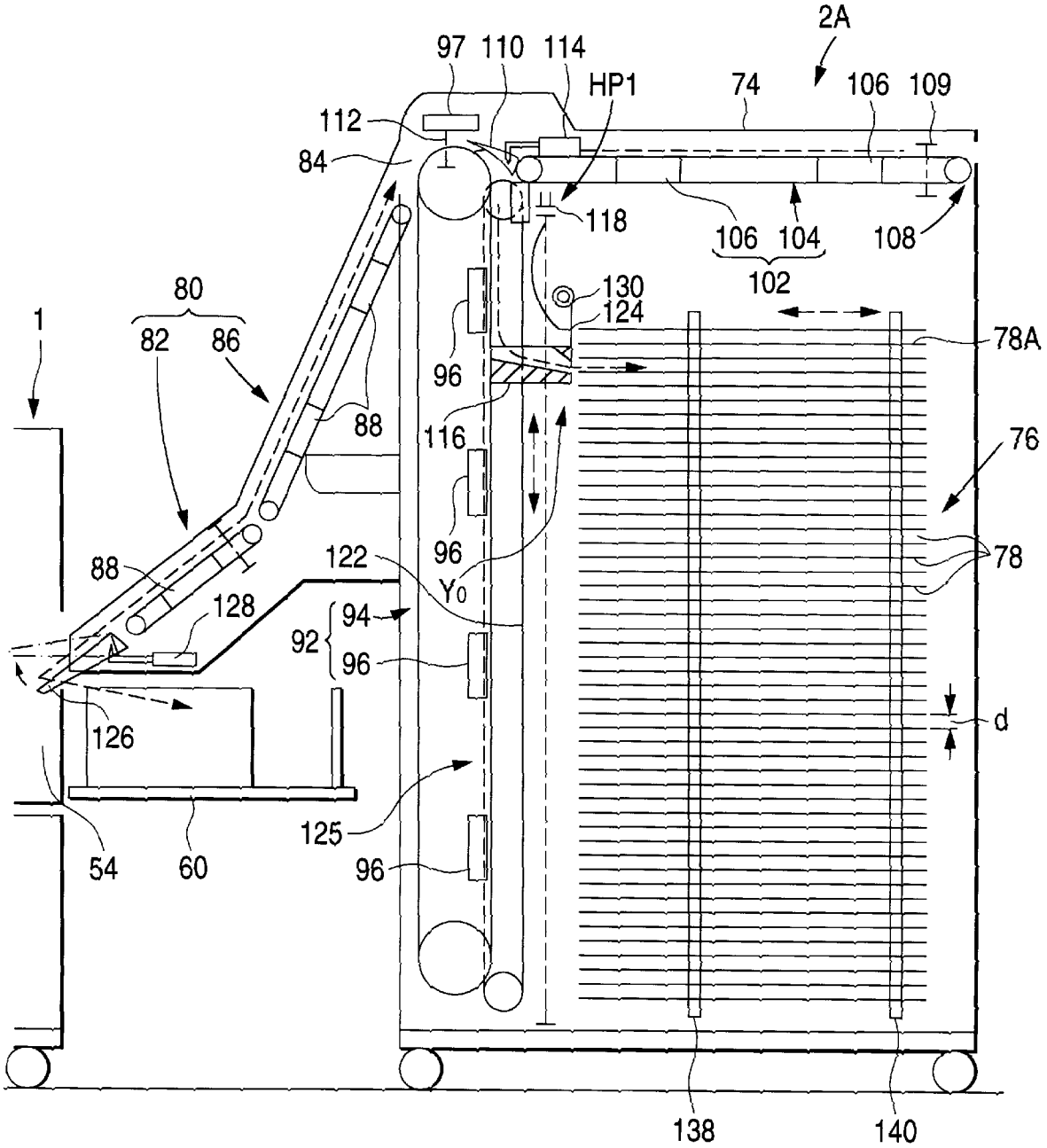
FIG. 2 is an enlarged view of a sorter in the image forming apparatus of the present invention.

In the space between the bin train 76 and the bin guide conveyer mechanism 92 lies the indexer 116 for causing the printed sheet P to be inserted in the predetermined bin 78 of the bin train 76. As shown in FIGS. 2–4, the indexer 116 has a rectangular support portion 116*a* substantially equal in width to the bin 78, and initially remains on standby in the home position HP1 set in a position slightly above the uppermost bin 78 (78A). An indexer HP sensor 118 for detecting the presence or absence of the indexer 116 is installed in the home position HP1.

Plate-like guide members 120 incorporated in the surface of the support portion 116*a* of the indexer 116 are formed at predetermined intervals in the width direction of the support portion 116*a*. In the example of FIG. 3, four sets of guide members 120 with two of them as a set are provided. The guide members 120 are uprightly provided in a position corresponding to the recess 100*b* of the frame 98 of the bin guide conveyer unit 92. The surface of the guide member 120 forms a guide plane 120*a* curving downward from the leading end close to the bin guide conveyer unit 92 up to the trailing end thereof. Further, the leading end portion of the guide member 120 is situated within a recess 100*b* of the stepped portion 100.

The indexer 116 is such that both ends of its support portion 116*a* are connected via a driving belt 122 to a driving means such as a DC servo motor or the like. Part of the surface 116*c* of the support portion 116*a* shown in FIG. 4 forms a guide surface contiguous to the guide plane 120*a* so as to guide the printed paper up to the entrance of the bin 78. Consequently, the guide plane 120*a* and the surface 116*c* of the support portion 116*a* define a 'guide plane' when applicable. Needless to say, this 'guide plane' may be in various forms.

A columnar through-hole 116*b* is formed in a substantially central position of the support portion 116*a* of the indexer 116. An indexer sensor 124 formed with a transmission type photosensor is installed in upper and lower positions in the vertical direction of the casing 74 in a manner holding the through-hole 116*b* therebetween. The indexer sensor 124 is used for detecting the printed sheet P passed on the guide plane 120*a* of the indexer 116, monitoring the situation in which printed sheet is unarriving or stagnant on the guide plane 120*a* of the indexer 116 and also detecting a jam error. In this case, the indexer 116, the driving belt 122 and the indexer sensor 124 constitute an indexer elevating mechanism 125. Incidentally, the indexer sensor 124 may be replaced with a photo-interrupter, which is provided for the indexer 116 and used for detecting the printed sheet P passed on the guide plane 120*a* of the indexer 116.

When the indexer 116 is driven by the DC servo motor as the driving means via the driving belt 122, the tip of the printed sheet P conveyed by the bin guide conveyer mechanism 92 is peeled off the conveyer belt 94*a* with the tips of the guide members 120, whereby the printed sheet P is received on the guide plane 120*a*. When the indexer sensor 124 detects that the printed sheet P has been accommodated in the bin train 76 for certain, the indexer 116 is made to move by the bin-to-bin 78 pitch with the home position HP1 as a reference position. The printed sheet P is thus inserted in each corresponding bin 78 of the bin train 76 one by one.

A switching plate 126 is installed on the entrance side of the preceding-stage belt conveyer unit 82 in the approach conveyer mechanism 80. The switching plate 126 is so controlled as to be switched when a solenoid 128 is turned on or off in accordance with the set mode. More specifically, the switching plate 126 is switched so that the printed sheet P is conveyed to the sheet discharge tray 60 of the stencil printing machine 1 when the non-sort mode has been set. On the other hand, the switching plate 126 is switched so that the printed paper P is conveyed to the first sorter 2A when the mode of using the second sorter 2B has been set. In this case, the switching plate 126 and the solenoid 128 constitute a switching mechanism 129.

A sheet member 130 which is wound in the form of a roll is installed in the uppermost position on the introduction end side of the uppermost bin 78A. One end of the sheet member 130 is fixedly secured to the casing 74 and the other end of the sheet member 130 as an open end is fastened to the indexer 116. The sheet member 130 operates to pay out and wind up the sheet, which operation is interlocked with the upward and downward movements of the indexer 116 and also prevents rebounding due to the sub-scan matching board 140 of a matching mechanism 136, which will be described later, when the printed paper P is accommodated in the bin 78. Incidentally, the bin-side surface of the sheet member 130 is made a reference matching plane $Y_0$ in the sub-scan direction when the sub-scan direction of the printed sheet P inserted in the bin 78 is matched.

In each of the bins 78 constituting the bin train 76, cut portions 132, 134 having predetermined lengths are formed along the direction (sub-scan direction) in which the printed sheet P inserted from the indexer 116 is conveyed and the direction (main scan directions) perpendicular to the direction in which the printed sheet P is conveyed, respectively. Further, a matching mechanism 136 for matching the printed sheet P inserted in the bin 78 with predetermined reference matching faces is provided in the positions corresponding to the cut portions 132, 134.

Figure 5:
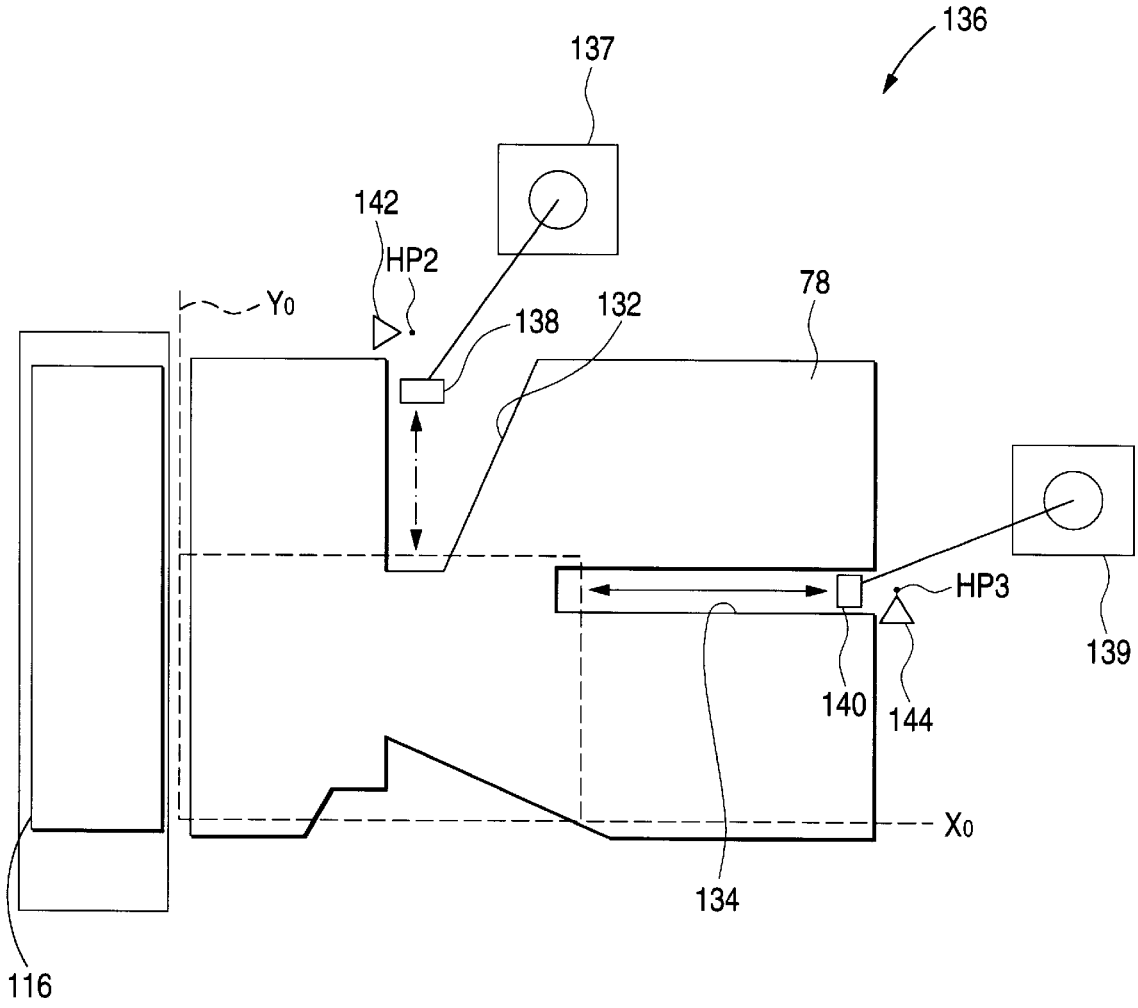
FIG. 5 is a plan view of a matching mechanism in the image forming apparatus of the invention.

FIG. 5 is a plan view of the matching mechanism 136. The reference matching planes $X_0$, $Y_0$ are set at the left lower corner of FIG. 5. More specifically, the reference matching plane $Y_0$ in the sub-scan direction is set on the bin-side surface of the sheet member 130 as described above, whereas the reference matching plane $X_0$ in the main scan direction is set on the inner wall surface of a cover member which can be opened and closed with respect to the casing 74, so that the cover member is made openable when the printed sheet P in the bin 78 is taken out.

The matching mechanism 136 has a main scan matching plate 138 which is moved in the main scan direction within the cut portion 132 extending in a direction perpendicular to the direction in which the printed sheet P is conveyed, and a sub-scan matching plate 140 which is moved in the sub-scan direction within the cut portion 134 extending therein.

The outermost position of the cut portion 132 is set to a main scan home position HP2 as a stand-by reference position when the main scan matching plate is moved. A main scan HP sensor 142 is installed in the proximity of the outermost position of the cut portion 132, for detecting whether or not the main scan matching plate 138 is positioned at the main scan home position HP2.

Similarly, the outermost position of the cut portion 134 is set to a sub-scan home position HP3 as a stand-by reference position when the sub-scan matching plate is moved. A sub-scan HP sensor 144 is installed in the proximity of the outermost position of the cut portion 134, for detecting whether or not the sub-scan matching plate 140 is provided at the sub-scan home position HP3. The main scan matching plate 138 and the sub-scan matching plate 140 are connected to, for example, pulse motors 137, 139 as driving means, respectively.

In other words, the main scan matching plate 138 is moved in the main scan direction by the pulse quantity with the main scan home position HP2 as a reference when the pulse quantity of the pulse motor as the driving means is determined according to preset sheet main-scan data in conformity with the size of printing sheet. Moreover, the sub-scan matching plate 140 is moved in the sub-scan direction by the pulse quantity with the sub-scan home position HP3 as a reference when the pulse quantity of the pulse motor as the driving means is determined according to preset sheet sub-scan data in conformity with the size of printing sheet.

Thus, the main scan matching plate 138 and the sub-scan matching plate 140 are moved in conformity with the size of the printing sheet. Accordingly, the printed sheet P inserted in each bin 78 of the bin train 76 from the indexer 116 is matched with the reference matching planes $X_0$, $Y_0$.

The size of printed sheet that can be accommodated in each bin 78 is restricted by the positional relation between the two matching plates 138, 140 and the positional relation between the HP sensors 142, 144 of the matching plates 138, 140. In other words, the minimum size of printing paper that can be accommodated in the bin 78 becomes what is defined by moving the two matching plates 138, 140 as much as possible from the home positions HP2, HP3 up to a position where the matching plates 138, 140 do not interfere with each other. Further, the maximum size of printed sheet that can be accommodated in the bin 78 becomes what allows the printed sheet to be accommodated therein without its interference with either HP sensor 142 or 144.

The stencil printing machine 1 and the sorter 2 thus arranged are connected together by mounting the approach conveyer mechanism 80 on the sheet discharge port 54 of the stencil printing machine 1. The operation of distributing and accommodating printing sheets in the bin train 76 of the sorter 2 is performed through pressing specific keys provided on the operating panel 146 of the stencil printing machine 1 as will be described below.

Figure 6:
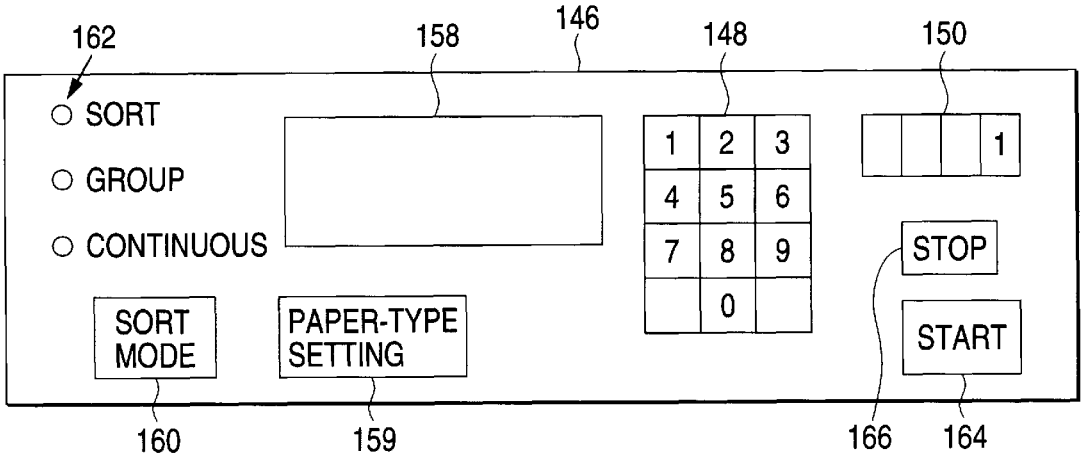
FIG. 6 is a diagram illustrating an operating panel which is installed in a stencil printing machine in the image forming apparatus of the invention.

FIG. 6 shows an operating panel mounted on a stencil printing machine. The operating panel 146 is provided with a ten key pad 148, a number-of-sheets LED 150, a display 158 such as a liquid crystal panel, a mode key 159 for setting different types of printing sheet, a sort mode key 160, a mode LED 162, a start key 164 and a stop key 166.

The ten key pad 148 includes number keys 0–9, which are used for setting the number of printing sheets and dimensions in the main scanning and sub-scanning directions of free size in a user mode.

The number-of-sheets LED 150 displays the number of sheets set by the ten key pad 148. The value displayed by the number-of-sheets LED 150 is synchronously decremented by one each time the printed sheet P is discharged during the printing operation performed by the stencil printing machine 1.

Figure 7:
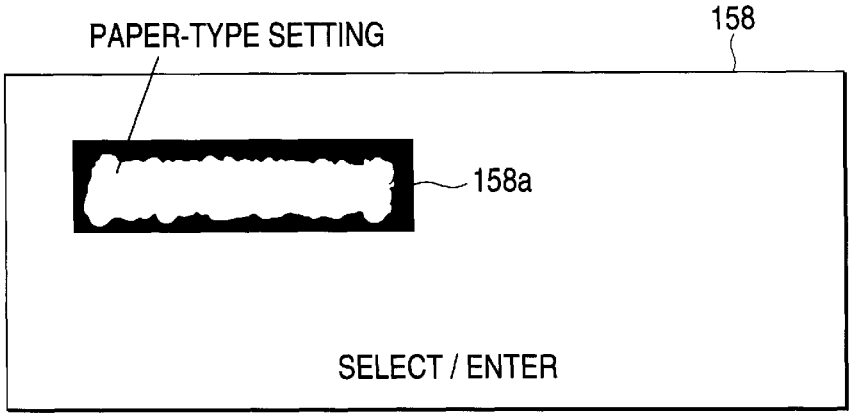
FIGS. 7(*a*) and 7(*b*) are diagrams showing examples of display screens when different types of printing sheet are set in the image forming apparatus of the invention.
Figure 7:
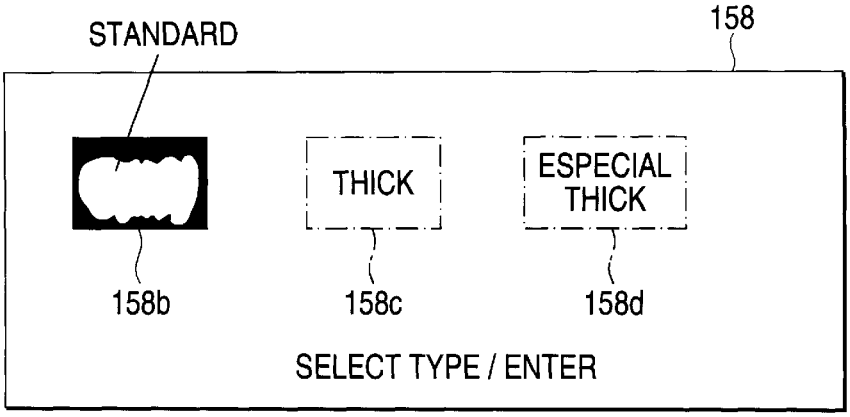

When the mode key 159 for setting different types of printing sheet, namely printing paper in this embodiment, is pressed, the display 158 displays a screen for use in inputting one type of printing paper in order to determine the stop position of the indexer 116. More specifically, an input display screen for displaying a key 158*a* for setting different types of printing paper as shown in FIG. 7(*a*) is made to appear as a software key instead through the operation of the mode key 159 for setting different types of printing paper. When the key 158*a* for setting types of printing paper is depressed, the screen is switched over to what displays keys 158*b*, 158*c*, 158*d* as software keys for respectively displaying different types of printing paper (for example, three types of 'standard paper', 'thick paper' and 'especially thick paper') as shown in FIG. 7(*b*). A vertical distance h between the bottom 78*a* of the upstream-side end portion of the bin 78 and the surface 116*c* of the downstream-side end portion of the indexer 116 is set on the input screen. In addition, the display 158 displays an error indication when an error such as a jam occurs, the size of printing paper P detected by the sheet feed mechanism 30 and the like.

The mode key 159 for setting different types of printing paper is pressed when a mode for changing the relative position (that is, stop position) of the indexer 116 to the bin 78 in accordance with the thickness of printing paper P to be used in the stencil printing machine 1 is selected.

The sort mode key 160 is pressed when one of the following modes is selected: a non-sort mode in which the printed paper P is accommodated by using the sheet discharge tray 60, one of the three modes (a sort mode, a group mode and a continuous mode) in which the printed paper P is accommodated by using the sorter 2. The sort mode key 160 is used for sequentially switching the following modes each time it is pressed after the operating panel is supplied with power: namely, from non-sort mode to sort mode, group mode, continuous mode and non-sort mode in a loop.

The non-sort mode refers to. a mode in which the printed paper P discharged from the sheet discharge port 54 of the stencil printing machine 1 is directly discharged onto the sheet discharge tray 60.

The sort mode refers to a mode in which the printed papers P discharged from the sheet discharge port 54 of the stencil printing machine 1 are page-to-page accommodated in the bins 78 in order to gather the plurality of pages into printed matter.

The group mode refers to a mode in which the printed papers P discharged from the sheet discharge port 54 of the stencil printing machine 1 are sorted into groups on a manuscript basis before being accommodated in the bins 78, which makes it possible to sort the printed papers into combinations of 'number of sheets×number of sets' on that manuscript basis.

The continuous mode refers to a mode in which the printed papers P discharged from the sheet discharge port 54 of the stencil printing machine 1 are distributed to and accommodated in each bin 78 by one sheet at a time so as to reduce the back printing of printed matter.

In the mode LED 162, the mode (the sort mode, the group mode or the continuous mode) selected by the sort mode key 160 is displayed. In a case where the mode LED 162 is not displayed, the non-sort mode is selected.

The start key 164 is pressed when the operation of the stencil printing machine 1 and the sorter 2 is performed. The stop key 166 is pressed when the operation of the stencil printing machine 1 and the sorter 2 is stopped.

Figure 8:
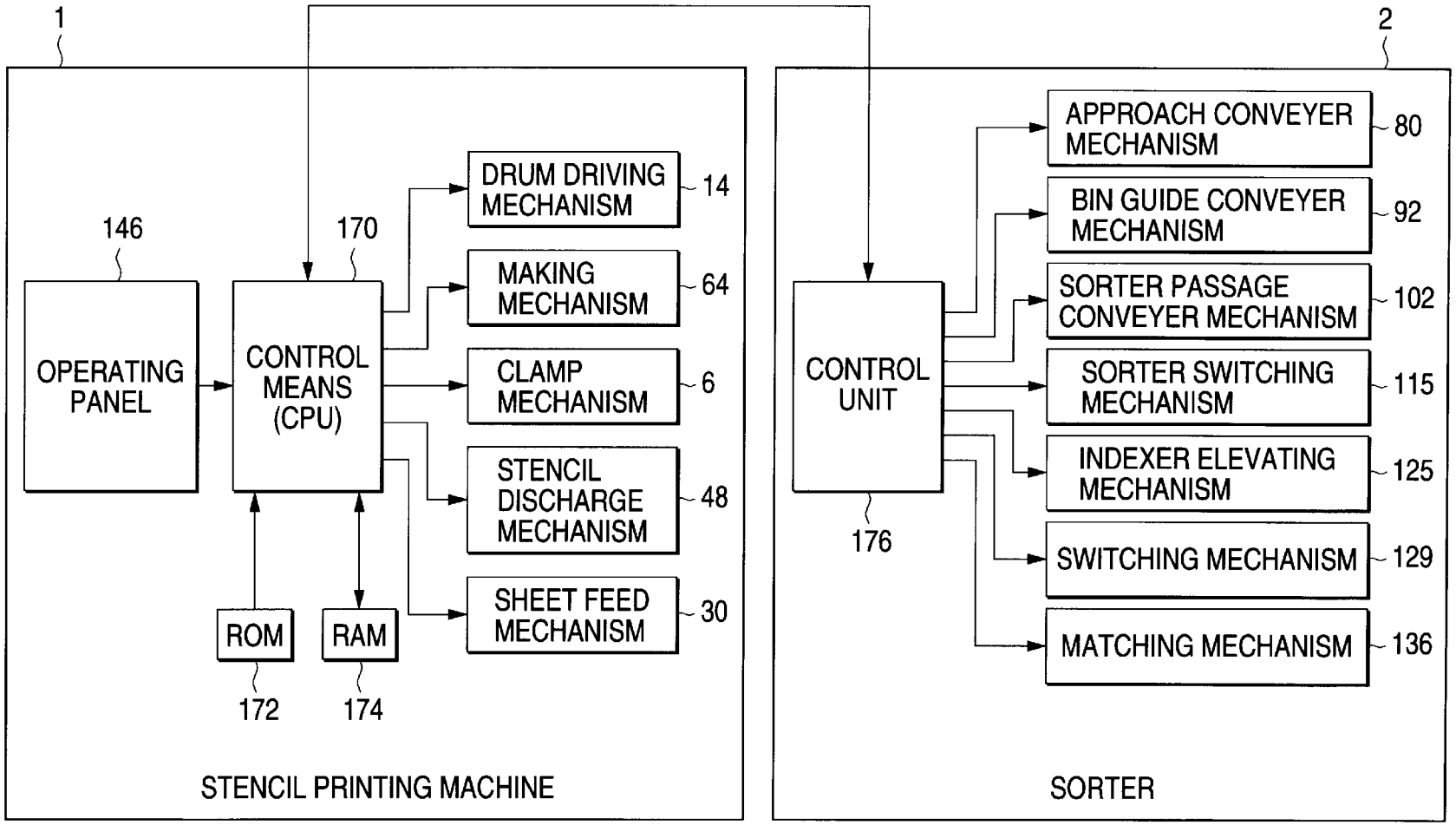
FIG. 8 is a block diagram illustrating an electrical arrangement in the image forming apparatus of the invention.

FIG. 8 is a block diagram illustrating an electrical arrangement of the aforesaid image forming system. In FIG. 8, a control means (CPU) 170 such as a microprocessor is used for controlling each of the mechanisms in the apparatus according to the program stored in a ROM 172.

A RAM 174 for storing information fed from the operating panel 146 is connected to the control means 170, the information including the number of printing, free size at the time the user mode is set, various sort modes and the like.

The control means 170 is used for controlling the rotation of the cylindrical drum 4 by issuing a rotation command to the drum driving mechanism 14. The control means 170 also issues to the making mechanism 64 a command of making up the stencil 8, to the clamp mechanism 6 a command of retaining/releasing the stencil 8 by/from the cylindrical drum 4, to the stencil discharge mechanism 48 a command of peeling the used stencil 8 off the cylindrical drum 4, and to the sheet feed mechanism 30 a command of performing the operation of feeding the printing paper P, which operation is interlocked with the drum driving mechanism 14.

As shown in FIG. 8, a control unit 176 for controlling the operation of each mechanism of the sorter 2 is provided on the sorter side. This control unit 176 and the control means 170 of the stencil printing machine 1 are electrically connected via a cable or the like, so that control information is exchanged therebetween. The control unit 176 is used for synchronously controlling the operation of the sorter 2 for successively taking in the printed papers P discharged one by one from the stencil printing machine 1 on the basis of control commands from the control means 170 under the control thereof.

When an error occurs on the part of the sorter 2, the control unit 176 notifies the occurrence of such an error to the control means 170 and deals with the error according to control instructions from the control means 170.

Consequently, the control unit 176 issues control commands to the approach conveyer mechanism 80, the bin guide conveyer mechanism 92, the sorter passage conveyer mechanism 102, the sorter switching mechanism 115, the indexer elevating mechanism 125, the switching mechanism 129, the matching mechanism 136 and the like in the sorter 2.

Under the command issued to each mechanism, the printed papers P discharged from the stencil printing machine 1 are sorted out and accommodated in the corresponding bins 78 in the sorter 2 in conformity with the set mode.

In this embodiment, the operating panel 146 is installed on the stencil printing machine side 1, a similar operating panel may be installed on the sorter side 2 so as to send set contents resulting from the operation of that operating panel to the control means 170 of the stencil printing machine 1. Moreover, the operating panels 146 may be installed in both stencil printing machine 1 and sorter 2.

Figure 9:
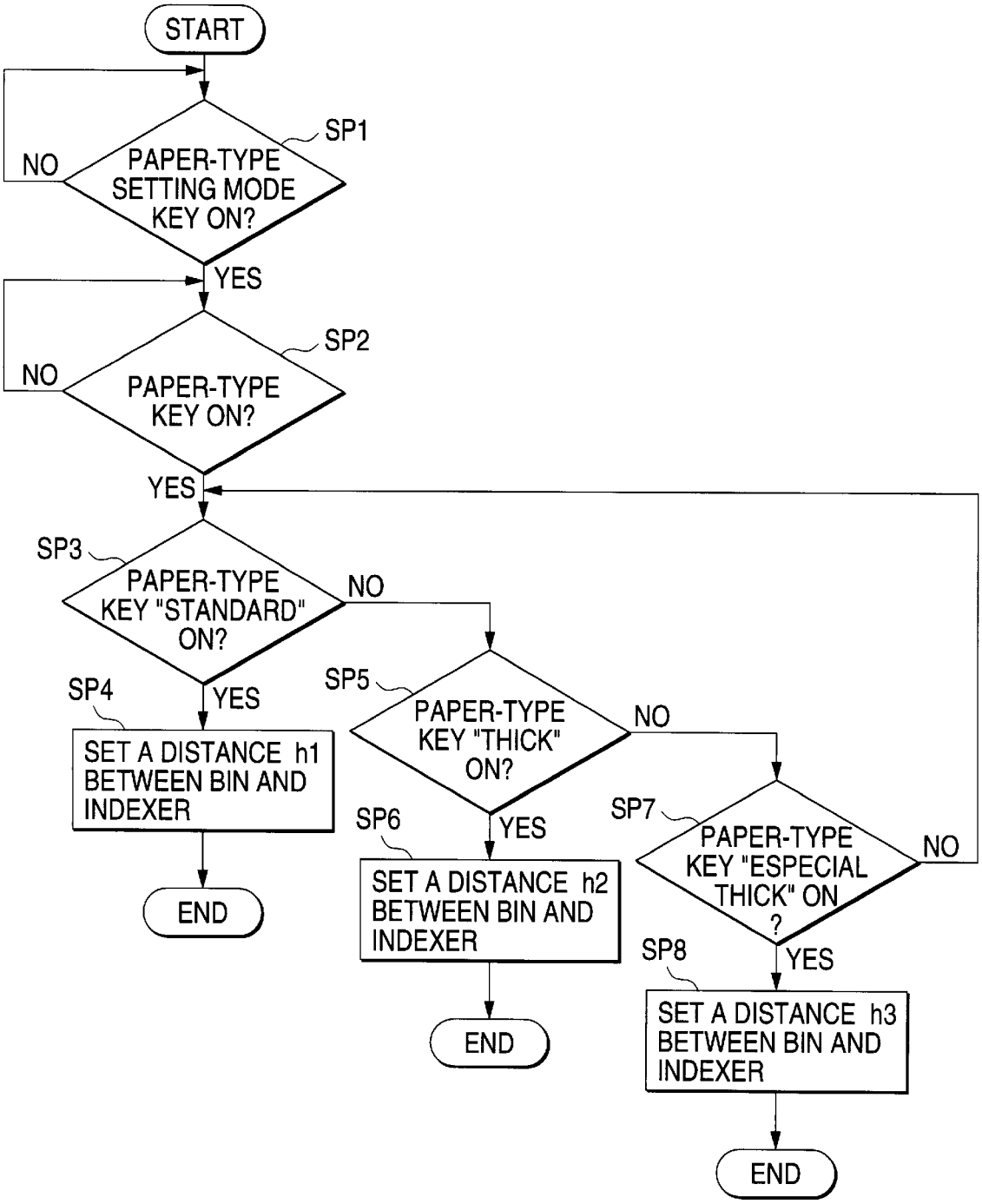
FIG. 9 is a flowchart showing a method of setting the relative position of the indexer to the bin in the image forming apparatus of the invention.

In the image forming system thus arranged, the relative position of the indexer 116 to the bin 78 is determined by setting the distance h between the bottom 78*a* of the bin 78 and the surface 116*c* of the indexer 116 as shown in a flowchart of FIG. 9 prior to the distribution of the printed papers P discharged from the stencil printing machine 1 in conformity with the respective modes.

When the mode key 159 for setting different types of printing paper of the operating panel 146 is pressed first (SP1-Yes), a mode for setting the distance h between the bottom 78*a* of the bin 78 and the surface 116*c* of the indexer 116 is adopted, whereby the display 158 turns to show an input display screen displaying the key 158*a* for setting different types of printing paper as shown in FIG. 7(*a*). When the key 158*a* for setting different types of printing paper is depressed ((SP2-Yes), the screen is switched over to what displays three kinds of keys 158*b*, 158*c*, 158*d* respectively displaying 'standard', 'thick' and 'especially thick' as shown in FIG. 7(*b*).

Under conditions that the bin-to-bin space of the bin 78 set to 20 mm and the number of printed papers to be stacked up per bin to 50, when the key 158*b* representing 'standard paper' is depressed (SP3-Yes), the control means 170 (or the control unit 176) sets the distance h between the bottom 78*a* of the bin 78 and the surface 116*c* of the indexer 116 to h1 (e.g., 9 mm) (SP4) according to the output. When the key 158*c* representing 'thick paper' is depressed (SP5-Yes), the control means 170 (or the control unit 176) sets the distance h between the bottom 78*a* of the bin 78 and the surface 116*c* of the indexer 116 to h2 (e.g., 12 mm) (SP6) according to the output. When the key 158*d* representing 'especially thick paper' is depressed (SP7-Yes), the control means 170 (or the control unit 176) sets the distance h between the bottom 78*a* of the bin 78 and the surface 116*c* of the indexer 116 to h3 (e.g., 15 mm) (SP8) according to the output.

When the setting of the relative position of the indexer 116 to the bin 78 is completed in accordance with the thickness of printing paper P for use in the stencil printing machine 1, the sort printing operation is made performable hereafter. Then the mode switching plate 126 is switched over to the sorter side 2 and so is the sorter switching plate 110 to the bin guide conveyer mechanism side 92, whereby the printed paper P discharged from the stencil printing machine 1 is conveyed via the approach conveyer mechanism 80 up to the following-stage belt conveyer unit 86.

When the printed paper P is guided and conveyed by the following-stage belt conveyer unit 86 up to the indexer 116, the indexer 116 is moved by the bin-to-bin pitch with the home position HP1 as a reference position. Thus the printed paper P is inserted in each corresponding bin 78 one by one.

Figure 10:
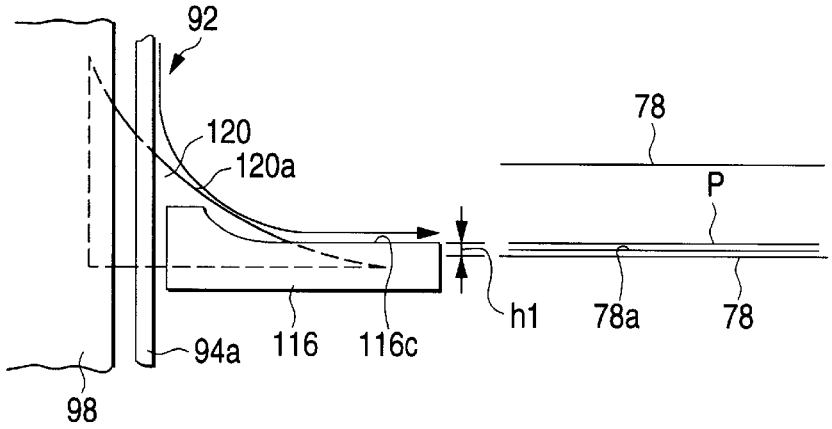
FIGS. 10(*a*), 10(*b*) and 10(*c*) are diagrams illustrating the relative positions of indexers according to the thickness of printing paper in the image forming apparatus of the invention.
Figure 10:
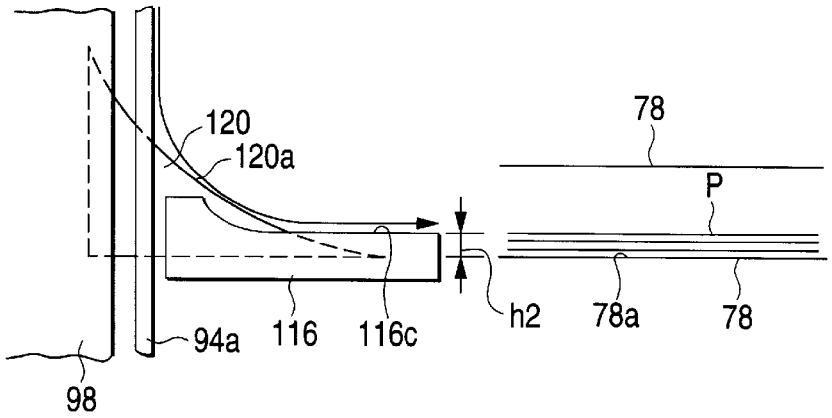
Figure 10:
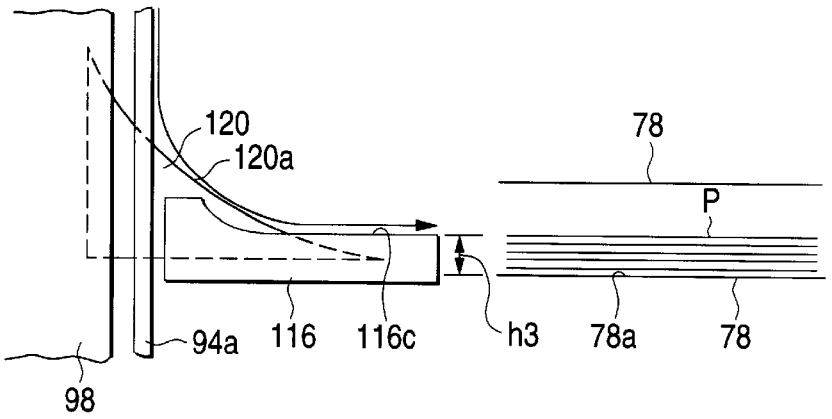

While the relative position of the indexer 116 to the bin 78 in accordance with the thickness of the printing paper P is set through the operation-of the operating panel 146, the indexer 116 is so controlled by the control unit 176 as to move up to the relative position, and to move by the bin-to-bin pitch with the relative position as a starting point. In other words, with the thickness of the paper being 'standard,' the indexer 116 is so controlled as to move in justification of the distance h1 set by depressing the key 158*b* for setting standard type of printing paper with the relative position as a starting point (a state shown in FIG. 10(*a*)). With the thickness of the paper being 'thick,' the indexer 116 is so controlled as to move in justification of the distance h2 set by depressing the key 158*c* for setting thick type of printing paper with the relative position as a starting point (a state shown in FIG. 10(*b*)). With the thickness of the paper being 'especially thick,' the indexer 116 is so controlled as to move in justification of the distance h3 set by depressing the key 158d for setting especially thick type of printing paper with the relative position as a starting point (a state shown in FIG. 10(*c*)).

When printing paper for use in the stencil printing machine 1 is thick or especially thick, the relative position of the indexer 116 to the bin 78 is thus set higher than the standard. When the thick or especially thick printing paper P is conveyed from the paper introducing port 84 to the bin guide conveyer mechanism 92, the indexer 116 is moved under the control of the control unit so that its surface 116*c* is positioned higher by the predetermined distance than the bottom 78*a* of the bin 78; that is, it is moved in justification of the distance h2 or h3 that has been set in conformity with the thickness of printing paper P for use in the stencil printing machine 1.

Therefore, even though the number of printed papers per bin increases because they are thick and even though the end of printed paper P is curled when it makes a U-turn in the curved corner portion of the bin guide conveyer mechanism 92 and passes thereon, the printed paper P conveyed from the conveyer mechanism 92 for next distribution can be accommodated without being impeded by the printed papers P that have already been stacked up. Consequently, a paper jam percentage is reduced and paper accommodating capacity per bin is also improved.

The vertical distance between the undersurface of the upstream-side end portion of a bin right above the target bin (the height of the space in the entrance portion of the bin 78) and the surface of the downstream-side end portion of the indexer 116 is naturally decreased by increasing the vertical distance h between the bottom surface of the upstream-side end portion of the bin 78 and the surface of the downstream-side end portion of the indexer 116 with respect to the preset bin-to-bin distance, so that the printed paper hardly enters the bin 78 with ease. However, the thicker the paper, the more reducible its deflection and the like become, whereby the insertion of the paper conveyed is less hampered.

Unless the distance h between the bottom 78*a* of the bin 78 and the surface 116*c* of the indexer 116 is especially set, the indexer 116 is so controlled as to move by the bin-to-bin pitch and to make the bottom 78*a* of the bin 78 conform to the surface 116*c* of the indexer 116 with the home position HP1 as the reference position.

The indexer 116 in the sorter 2 is moved to a desired bin 78 in conformity with the mode (the sort mode, the group mode or the continuous mode) selected by the sort mode key 160.

Then the second sorter 2B is installed as an additional one of the first sorter 2A in order to basically sort out more printed papers P. The printed papers P are conveyed to the second sorter 2B by switching the sorter switching plate 110 over to the sorter passage conveyer mechanism side 102, whereby the printed paper F is conveyed via the sorter passage conveyer mechanism 102 to the following second sorter 2B before being inserted in the corresponding bin 78 as in the first sorter 2A.

Thus, the printed paper P is inserted in the sorter 2 (2A or 2B) in accordance with the mode (the sort mode, the group mode or the continuous mode) selected by the sort mode key 160.

Figure 11:
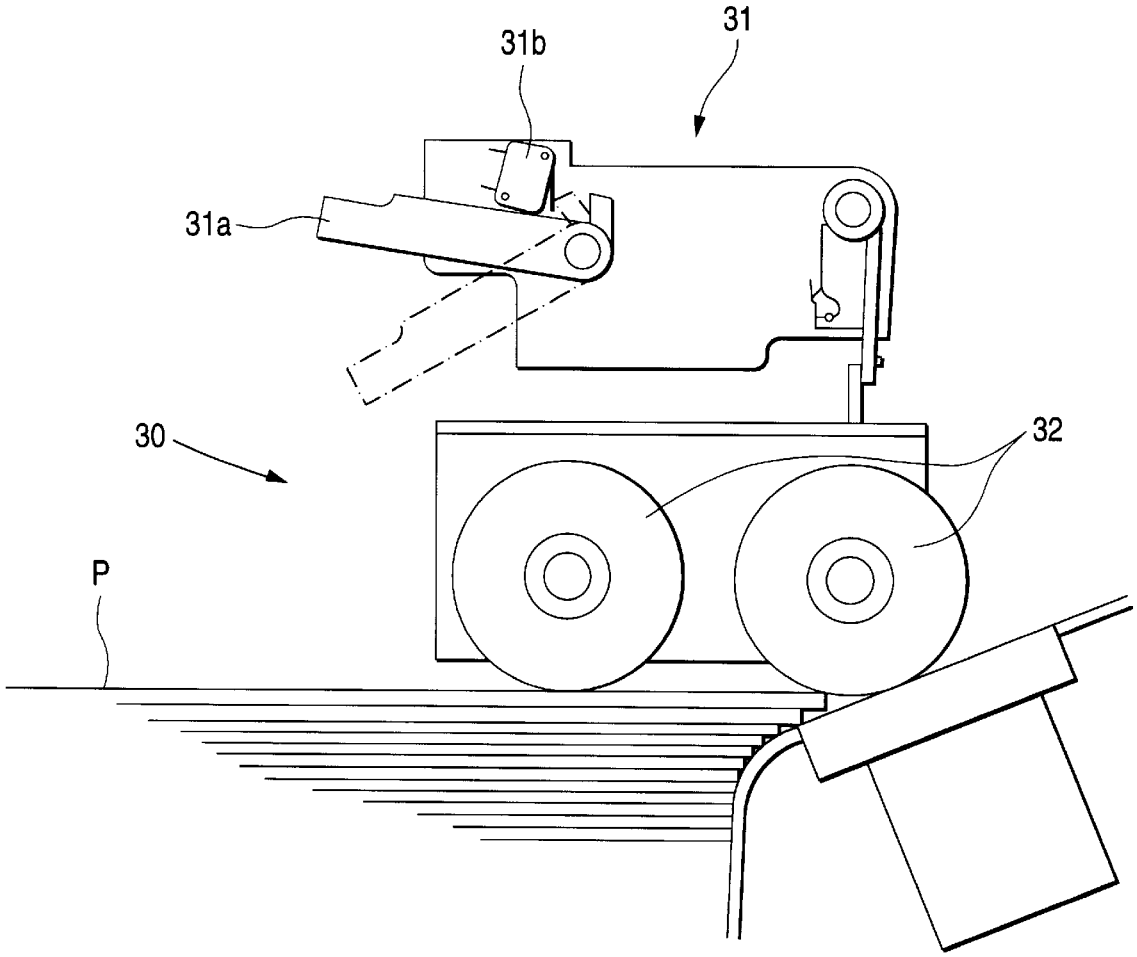
FIG. 11 is a block diagram of a sheet feed mechanism, in place of the operating panel, for setting different kinds of printing sheets the image forming apparatus of the invention.
Figure 12:
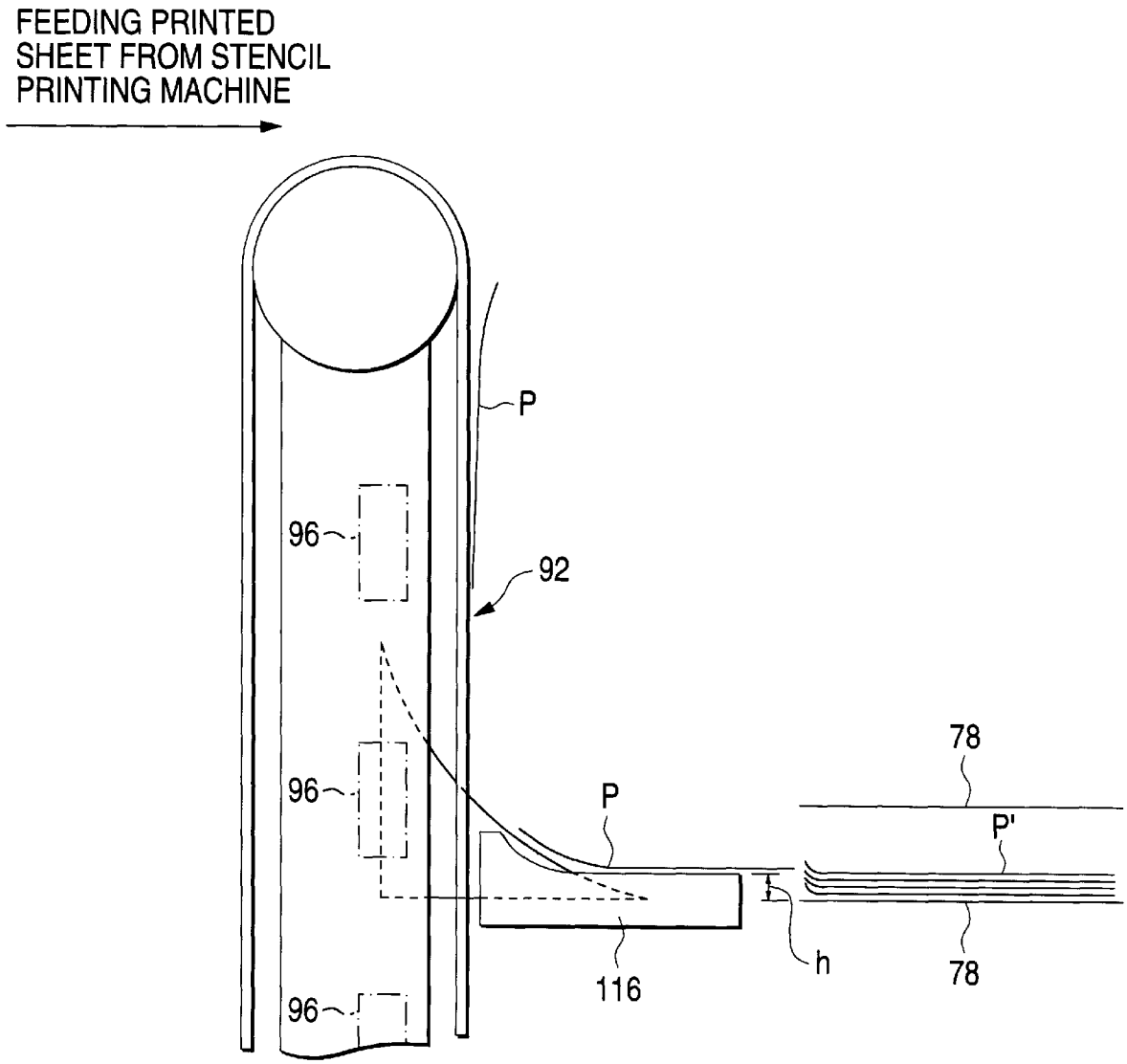
FIG. 12 is a diagram illustrating a state in which printed sheet is accommodated an abnormal manner.

In this embodiment, the operating panel 146 is used to set one type of printing paper so as to determine the relative position of the indexer 116 to the bin 78, the different types of printing paper in terms of their thickness are not limited to 'standard', 'thick' and 'especially thick' but may include other kinds of thickness to be allocated. At this time, it is unnecessary to allocate a key to each kind of thickness, provided a combination of keys can be set, a smaller number of keys may be used for setting more kinds of thickness. A sheet-feed-pressure varying mechanism shown in FIG. 11 may be used for setting the relative portion of the indexer 116 to the bin 78.

The sheet-feed-pressure varying mechanism 31 is provided for the sheet feed mechanism 30 of the stencil printing machine 1 and fitted with a lever 31*a* for varying the paper sheet pressure in accordance with the thickness of the printing sheet P mounted on the paper feed tray 28, and a microswitch 31*b* which is turned on and off as the lever 31*a* is turned.

In the sheet-feed-pressure varying mechanism 31, the lever 31*a* is situated (as shown by a solid line of FIG. 11) so as to turn off the microswitch 31*b* when the printing sheets P mounted on the sheet feed tray 28 are 'standard' in thickness. The lever 31*a* is also situated (as shown by a chain line of FIG. 11) so as to turn on the microswitch 31*b* when the printing sheets P mounted on the paper feed tray 28 are 'thick.' Thus, information about the thickness of the printing sheets P is obtainable.

The control means 170 (or the control unit 176) sets the relative position of the indexer 116 to the bin 78 on the basis of the information concerning the thickness of the printing paper and moves the indexer 116 under its control. While the indexer 116 is so controlled as to move in justification of the distance h1 between the bottom 78*a* of the bin 78 and the surface 116*c* of the indexer 116 (the state shown in FIG. 10(*a*)), whereas while the microswitch 31*b* is held ON, the indexer 116 is so controlled as to move in justification of the distance h2 between the bottom 78*a* of the bin 78 and the surface 116*c* of the indexer 116 (the state shown in FIG. 10(*b*)).

Although the control of the relative position of the indexer 116 to the bin 78 is assumed on the basis of information on only the thickness of printing sheet according to the aforesaid embodiments of the invention, the control thereof may be effected on the basis of information on the density of printing sheet (mass per unit area). In this case, the greater the density of printing paper, the higher the surface 116*c* of the indexer 116 is set than the bottom 78*a* of the bin 78, whereby the indexer 116 is so controlled as to move with the set position as a starting point. Further, the information for use in determining the relative position of the indexer 116 may be information deriving from a combination of thickness and density of printing sheet.

Although the bins 78 are installed horizontally in the aforesaid embodiments of the invention, the invention is needless to say applicable to those tilted with respect to the horizontal plane. In this specification, the 'upstream side' and 'downstream side' are used in reference to the direction in which printed papers are conveyed.

Although the approach conveyer mechanism 80 is employed according to the aforesaid embodiments of the invention, moreover, the printed sheet P discharged from the image forming machine may be conveyed directly to the upper end portion of the conveyer mechanism 92 without installing the approach conveyer mechanism 80 if the discharge portion of the image forming machine is different in arrangement.

In this embodiment, a stencil printing machine is used for an image forming machine of the image forming apparatus of the invention. However, various image forming machines, such as a copying machine, a printer and the like, may be used in the image forming apparatus of the present invention.

Although the relative position of the indexer 116 to the bin 78 is controlled on the basis of information about the thickness or density of printing sheet on the assumption that the bin-to-bin distance and the maximum accommodating capacity per bin are constant according to the aforesaid embodiments of the invention, the number of accommodatable printed sheets in each bin may be increased by controlling the relative position of the indexer 116 to the bin 78 on the basis of information about the thickness of printing sheet and the estimated number of printed sheets or a combination of the former and the number of accommodated printed papers. In this case, the greater the estimated number of accommodating printed sheets per bin (or the number of accommodated printed sheets) or the thicker the printed sheet, the greater the distance between the downstream-side end surface portion of the indexer 116 and the upstream-side end bottom portion of the bin 78 (hereinafter called the 'set distance') becomes. The estimated number of accommodating sheets is easily obtainable from data on the number of copies set on the image forming machine and information about the number of bins, the mode in which the sorter is used and the like. Otherwise, an input means for inputting the estimated number of sheets per bin may be provided on the image forming machine or sorter side. Moreover, the number of accommodating sheets per bin may be obtained by controlling the number of accommodated sheets per bin by using a transmission type sensor (the indexer sensor 124 of FIG. 2) through which the sheets of printed papers are passed and a memory means.

Figure 13:
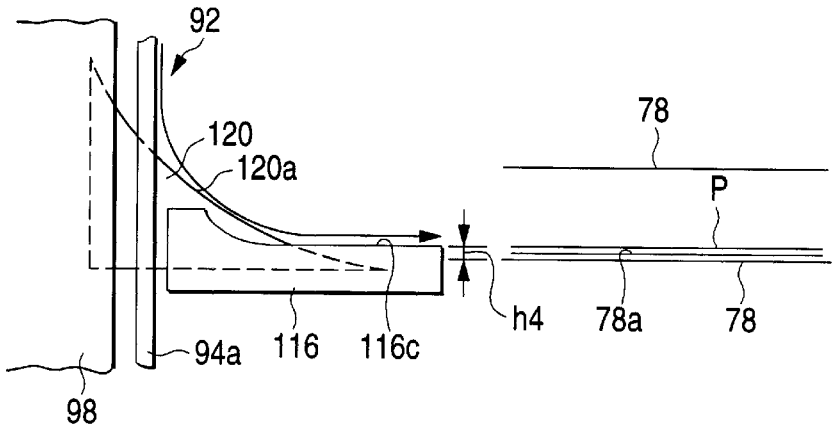
FIG. 13(*a*), 13(*b*) and 13(*c*) are diagrams illustrating the relative positions of indexers corresponding to different combinations of thickness of printed papers and the number of sheets accommodated in each bin.
Figure 13:
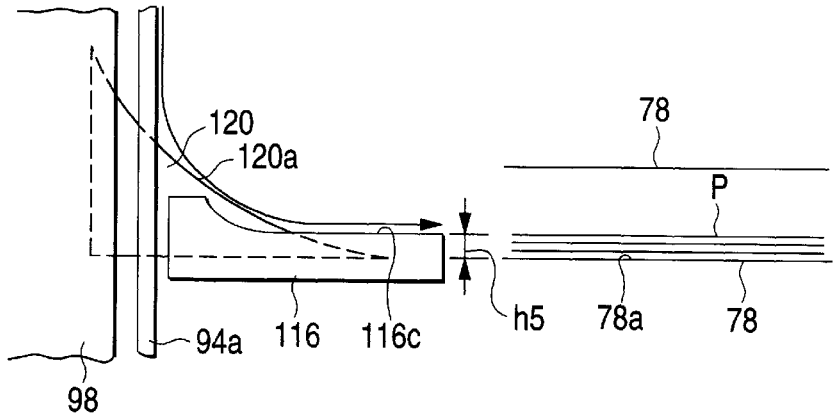
Figure 13:
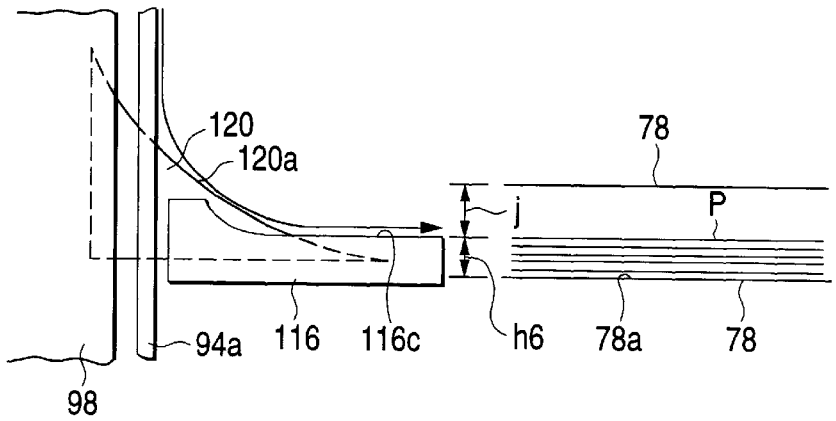

FIGS. 13(*a*)–13(*c*) show, for example, a case where the aforementioned set distance is variably controlled with the combination of the thickness of printed paper and the number of accommodated sheets per bin. Assuming the bin-to-bin distance is 20 mm and printed papers having ordinary thickness (e.g., 0.1 mm) are accommodated, the set distance is made h4 (e.g., 5 mm) when the number of accommodating sheets per bin becomes 30, for example. The set distance is made h5 (e.g., 7 mm) when the number of accommodating sheets per bin becomes 50 and the set distance is made h6 (e.g., 9 mm) when the number of accommodating sheets per bin becomes 70. When the thickness of accommodating printed paper becomes greater than that in the preceding cases, the stop position of the indexer 116 in this case is raised. An increase in the set distance may be made each time the number of printed papers accommodated in the bin 78 is incremented by one or otherwise by ten. In this case, though it seems feasible to increase the number of accommodating sheets per bin by increasing the set distance since the bin-to-bin distance is 20 mm, making steeper the curve of the travel route of the indexer 116 for the purpose of reducing the size of the apparatus tends to render unstable the passage of the printed paper through the indexer 116, thus causing a paper jam at the entrance of the bin 78. Therefore, the vertical distance j between the undersurface of a bin right above the target bin and the surface of the uppermost printed paper accommodated in the target bin should allow for a certain space (e.g., 10 mm).

Although the set distance is variably controlled with the combination of the thickness of printed paper and the number of accommodated sheets in the case of FIG. 13, the estimated number of accommodating sheets may be employed to variably control the set distance without using the number of accommodated sheets per bin. Since one value is given to one estimated number of accommodating sheets as far as the set distance is concerned, the set distance is never increased or decreased. The density, instead of the thickness, of printing paper may also be employed as a reference for variable control of the set distance. In this case, control is assumed so that the greater the density of printing paper, the greater the set distance becomes.

An image forming apparatus in which the indexer stops at a regular position irrespective to the thickness of sheets has the following difficulties: When the regular position is set for thin sheets, that is, a set distance is short, the designated number of thick sheets cannot be accommodated as discussed above. On the other hand, when the regular position is set for thick sheets, that is, a set distance is long, a thin sheet may come in contact with a bin above the bin which receives the thin sheet. Therefore, a sheet jam may occur more frequently. With respect to the present invention, the stop position of the indexer changes depending on the thickness of the sheet so that much more sheets are stacked on each bin without jamming.

What is claimed is:

1. An image forming apparatus comprising:

image forming means for printing an image on a printing sheet;

a plurality of bins arranged in a vertical direction;

conveyer means provided vertically along the plurality of bins, for vertically conveying the printing sheet downward discharged from the image forming means;

printed sheet guide means having a guide surface in its upper portion, being vertically movable along a sheet travel route of the conveyer means, for peeling the printing sheet vertically conveyed downward by the conveyer means off a belt of the conveyer means with the guide surface and sending the printing sheet in one of the plurality of bins;

control means for controlling driving of the conveyer means and the printed sheet guide means in accordance with the printing sheet discharged from the image forming means; and printing sheet information input means for inputting to the control means information on a thickness of the printing sheet for use in the image forming means, wherein the control means variably controls a vertical distance between a bottom surface of an upstream-side end portion of one of the plurality of bins and a downstream-side end portion of the guide surface of the printed sheet guide means in response to an output of the printing sheet information input means when the printing sheet is inserted in one of the plurality of bins by moving up or down the printed sheet guide means.

2. The image forming apparatus according to claim 1, wherein the printing sheet information input means inputs to the control means a signal which is turned on·off in accordance with a variation of pressure applied to the printing sheet supplied to the image forming means as information on the thickness of the printing sheet.

3. The image forming apparatus according to claim 1, wherein the printing sheet information input means inputs to the control means a key signal which is operated in accordance with the thickness of the printing sheet as information on the thickness of the printing sheet.

4. An image forming apparatus comprising:

image forming means for printing an image on a printing sheet;

a plurality of bins arranged in a vertical direction;

conveyer means provided vertically along the plurality of bins, for vertically conveying the printing sheet downward discharged from the image forming means;

printed sheet guide means having a guide surface in its upper portion, being vertically movable along a sheet travel route of the conveyer means, for peeling the printing sheet vertically conveyed downward by the conveyer means off a belt of the conveyer means with the guide surface and sending the printing sheet in one of the plurality of bins;

control means for controlling driving of the conveyer means and the printed sheet guide means in accordance with the printing sheet discharged from the image forming means; and printing sheet information input means for inputting to the control means information on a density of the printing sheet for use in the image forming means, wherein the control means variably controls a vertical distance between a bottom surface of an upstream-side end portion of one of the plurality of bins and a downstream-side end portion of the guide surface of the printed sheet guide means in response to an output of the printing sheet information input means when the printing sheet is inserted in one of the plurality of bins by moving up or down the printed sheet guide means.

5. The image forming apparatus according to claim 4, wherein the printing sheet information input means inputs to the control means a key signal which is operated in accordance with the density of the printing sheet as information on the density of the printing sheet.

6. An image forming apparatus comprising:

image forming means for printing an image on a printing sheet;

a plurality of bins arranged in a vertical direction;

conveyer means provided vertically along the plurality of bins, for vertically conveying the printing sheet downward discharged from the image forming means;

printed sheet guide means having a guide surface in its upper portion, being vertically movable along a sheet travel route of the conveyer means, for peeling the printing sheet vertically conveyed downward by the conveyer means off a belt of the conveyer means with the guide surface and sending the printing sheet in one of the plurality of bins;

control means for controlling driving of the conveyer means and the printed sheet guide means in accordance with the printing sheet discharged from the image forming means;

printing sheet information input means for inputting to the control means information on a thickness of the printing sheet for use in the image forming means; and number-of-sheets information input means for inputting to the control means information on a number of printing sheets which are inserted in each of the plurality of bins, wherein the control means variably controls a vertical distance between a bottom surface of an upstream-side end portion of one of the plurality of bins and a downstream-side end portion of the guide surface of the printed sheet guide means in response to an output of the printing sheet information input means and an output of the number-of-sheets information input means when the printing sheet is inserted in one of the plurality of bins by moving up or down the printed sheet guide means.

7. An image forming apparatus comprising:

image forming means for printing an image on a printing sheet;

a plurality of bins arranged in a vertical direction;

conveyer means provided vertically along the plurality of bins, for vertically conveying the printing sheet downward discharged from the image forming means;

printed sheet guide means having a guide surface in its upper portion, being vertically movable along a sheet travel route of the conveyer means, for peeling the printing sheet vertically conveyed downward by the conveyer means off a belt of the conveyer means with the guide surface and sending the printing sheet in one of the plurality of bins;

control means for controlling driving of the conveyer means and the printed sheet guide means in accordance with the printing sheet discharged from the image forming means;

printing sheet information input means for inputting to the control means information on a density of the printing sheet for use in the image forming means; and number-of-sheets information input means for inputting to the control means information on a number of printing sheets which are inserted in each of the plurality of bins, wherein the control means variably controls a vertical distance between a bottom surface of an upstream-side end portion of one of the plurality of bins and a downstream-side end portion of the guide surface of the printed sheet guide means in response to an output of the printing sheet information input means and an output of the number-of-sheets information input means when the printing sheet is inserted in one of the plurality of bins by moving up or down the printed sheet guide means.

8. A sorter for sorting a printed sheet discharged from an image forming machine, the sorter comprising:

a plurality of bins arranged in a vertical direction;

a conveyer provided vertically along the plurality of bins to convey the printed sheet vertically downward;

an indexer having a guide surface in its upper portion, being vertically movable along a sheet travel route of the conveyer, for peeling the printed sheet off the conveyer with the guide surface and sending the printed sheet in one of the plurality of bins;

a controller connecting to the conveyer and the indexer, for driving the conveyer and the indexer; and an operating panel connected to the controller, wherein the operating panel receives printing sheet information of the sheet to be printed and feeds the information to the controller, and the controller determines a vertical distance between a bottom surface of an upstream-side end portion of one of the plurality of bins and a downstream-side end portion of the guide surface of a printed sheet guide means in response to the information from the operating panel.

9. The sorter according to claim 8, wherein the information of the sheet in the operating panel includes a thickness of the sheet to be printed.

10. The sorter according to claim 9, wherein the information of the sheet in the operating panel further includes a number of printed sheets which are inserted in each of the plurality of bins.

11. The sorter according to claim 8, wherein the information of the sheet in the operating panel includes a density of the sheet to be printed.

12. The sorter according to claim 11, wherein the information of the sheet in the operating panel further includes a number of printed sheets which are inserted in each of the plurality of bins.

* * * * *